United States Patent [19]

Penque

[11] 4,018,620

[45] Apr. 19, 1977

[54] METHOD OF HYDROLYZING CELLULOSE TO MONOSACCHARIDES

[75] Inventor: Ronald A. Penque, Glen Ridge, N.J.

[73] Assignee: Biocel Corporation, New York, N.Y.

[22] Filed: May 19, 1975

[21] Appl. No.: 578,462

[52] U.S. Cl. ..... 127/37

[51] Int. Cl.[2] ..... C13K 1/02

[58] Field of Search ..... 127/37

[56] References Cited

UNITED STATES PATENTS

| | | | |
|---|---|---|---|
| 1,096,030 | 5/1914 | Gallagher | 127/37 |
| 1,242,030 | 10/1917 | Ostenberg | 127/37 |
| 1,355,415 | 10/1920 | Ostenberg | 127/37 |
| 1,428,217 | 9/1922 | Classen | 127/37 |
| 1,936,190 | 11/1933 | Dreyfus | 127/37 |
| 2,801,955 | 8/1957 | Rutenberg | 127/37 X |
| 2,868,778 | 1/1959 | Watson | 127/37 X |
| 3,212,932 | 10/1965 | Hess | 127/37 |
| 3,479,248 | 11/1969 | Nobile | 127/37 X |

OTHER PUBLICATIONS

Chemical Abstracts, 23:15599, (1929).
Chemical Abstracts, 33:P35867, (1939).

*Primary Examiner*—Morris O. Wolk
*Assistant Examiner*—Sidney Marantz
*Attorney, Agent, or Firm*—Morton C. Jacobs

[57] ABSTRACT

A method of hydrolyzing cellulose to monosaccharides, especially glucose, by subjecting cellulose, under controlled temperature and pressure, to an aqueous mixture of calcium chloride and an acid, preferably hydrochloric acid, providing a low concentration of $H^+$. When the starting material is pure alpha cellulose, glucose is produced in very high yields. When the starting material is a mixture of hemi and alpha cellulose, the resultant product is a mixture of pentose (xylose) and hexose (glucose) sugars. Refluxing the reaction mixture containing pure alpha cellulose, about 55% calcium chloride and only about 0.01% hydrochloric acid, based on the total reaction mass, will produce in a relatively short time relatively high yields of glucose.

10 Claims, No Drawings

METHOD OF HYDROLYZING CELLULOSE TO MONOSACCHARIDES

This invention relates to the production of reducing sugars in general and monosaccharides in particular by the chemical hydrolysis or degradation of cellulose.

As is well-known, pure cellulose consists of long chains of glucose molecules linked in glucosidic (beta) combinations. The glucosidic bonds can be broken by specific enzymes or chemical reagents with attendant hydrolysis of the cellulose to glucose. Hemi-cellulose hydrolyzes not only to glucose but also to other reducing monosaccharides such as xylose.

The literature is replete with the investigation of various reagents to effect swelling and solubilizing of cellulose in which the fibers are hydrated and then hydrolyzed to glucose.

The state of the art is reviewed in "High Polymers" published by Wiley-Interscience, a division of John Wiley & Sons, Inc. Part IV Cellulose and Cellulose Derivatives (1971) which is herein incorporated by reference. Among the mineral acids which swell and dissolve cellulose (cotton), investigators found that hydrochloric acid in concentrations less than 35% had little swelling action on cotton. In concentrations of 37–38% hydrochloric acid, cotton swelled and gelatinized and rapidly dissolved in 40–42%, maximum swelling apparently occurring in 40% acid and rapid dissolution at room temperature in 41–42% acid.

Investigations of the effect of salts have shown that zinc chloride in concentrations in excess of 50% has a swelling effect on cellulose fibers and that certain other halides at certain concentrations and temperatures also have a swelling and/or solvent action on cellulose. One experimenter, Honsch, reported the swelling of cotton in calcium chloride at high temperatures, whereas another, Bartunek, found that calcium chloride solutions had little effect on linter sheets, and still others, Williams and Erbring and Geinitz, reported that calcium chloride had no effect on cellulose (p. 347 of the aforesaid "High Polymer" publication, Part IV).

Deming in J. Am. Chem. Soc. 33, 1515–1525 (1911) reported that the rate of hydrolysis of cellulose appears to vary with the nature of the metallic salts in the presence of free hydrochloric acid. Neutral solutions of the halogen salts of the alkalies and alkaline earths were unable to effect solution of cellulose and the chlorides of the alkalies and alkaline earths did not dissolve cellulose even in hydrochloric acid. Solution of cellulose was effected in a mixture, for example, of calcium chloride and formic acid, alone or together with hydrochloric acid, in which case the cellulose is esterified and a portion is dissolved in the solution of calcium chloride at 130° C. The product recovered from the solution is not an ester but a modified cellulose produced by the saponification of the ester by the hydrochloric acid. The modified cellulose is soluble in concentrated hydrochloric acid and long action of the strong acid solution results in the production of glucose.

Contrary to the teachings of the prior art, it was found that by subjecting cellulose to an aqueous mixture of calcium chloride containing a small concentration of $H^+$, preferably as free hydrochloric acid, and controlling the time and temperature of the reaction, cellulose can be converted virtually quantitatively to glucose, if pure alpha cellulose is used, or to reducing sugars including glucose if alpha plus hemi-cellulose are used.

Although the mechanism of the reaction is not known, it is postulated that the relatively large quantity of calcium chloride, because it is very hygroscopic, provides water molecules at the glucoside linkages and the small $H^+$ concentration breaks the linkage whereupon two molecules of water are added at the site to produce the reducing sugars including glucose.

The instant method provides marked advantages. Economy is affected by eliminating the need for concentrated hydrochloric acid, higher tempertures and higher pressures for high yield conversion to glucose. Additionally, with high concentrations of hydrochloric acid, cellulose is not only dissolved but there is a danger of degradation beyond glucose to organic acids, chars and other organic products. The removal of calcium from the final glucose-containing reaction mixture is easily effected. After removal of most of the calcium chloride, the reaction mixture is suitable for fermentation or feed stocks since traces of calcium are not toxic. Contrariwise, if zinc, beryllium and other cellulose swelling metal salt hydrates are used, the presence of these salts in the glucose-containing reaction mixture will be an impediment to the food or fermentation processes.

If pure alpha cellulose is used, the feedstock is a glucose solution. If hemi and alpha cellulose, as in newsprint, are used, the feedstock is a mixture of pentose (xylose) and hexose (glucose) sugars. Yeasts are known which can ferment the pentose and hexose sugars to alcohol. Alternatively, if the yeasts are caused to multiply aerobically with the feedstock as the nutrient, the yeast cells will yield edible protein.

The following are non-limitative examples of the instant method:

EXAMPLE 1

The following reaction mixture was charged into a Resin Reaction flask equipped with reflux and agitator:

| | Wt. (gm) | % of Total Mass |
|---|---|---|
| $CaCl_2$ | 600.0 | 18.81 |
| HCl (Con. 38%) | 30.0 | 0.36 (as HCl) |
| Ash-free analytical filter pulp (pure alpha cellulose) | 189.1 | 5.93 |
| Water (tap) | 2370.0 | 74.31 |
| Total Mass = | 3189.1 | |

In the initial heating stage, the reaction mass was very viscous and could not be agitated. The temperature rose to approximately 104° C where it took up a great deal of heat and the temperature remained at 104° C for about 20 minutes before it rose one degree to about 105° C. At this temperature the pulp began to disintegrate to an apparent "colloidal" form and agitation was possible. About one hour thereafter the viscosity of the mass dropped and a milky white dispersion was formed.

Aliquots of the reaction mass were neutralized with ammonia after 12, 24, 41 and 44 hours and all were tested for the presence and semi-quantitative measurement of glucose with Tes-Tape, urine sugar analysis paper marketed by Eli Lilly and Company, Indianapolis, Ind. These are color strips impregnated with the enzyme glucose oxidase and peroxidase and an oxidizable substrate orthotolidine. When the tape is immersed in a glucose-containing solution, the glucose oxidase catalyzes the reaction of the glucose with oxygen from the air to form gluconic acid and hydrogen peroxide. Then the enzyme peroxidase catalyzes the reaction of hydrogen peroxide and orthotolidine to form a blue color. With the addition of a yellow dye (FDC Yellow No. 5) to the paper, the color range of the test is from yellow to light green to deep blue. The Tes-Tape container contains a color chart with approximate glucose concentrations for each color from 0% for yellow to 2% for deep blue. In practice, about ¼ inch of the tape is immersed in the test solution and removed immediately, then, after waiting one minute, is compared to the color chart.

The 12-hour tape was very light green and the 24, 41 and 44-hour tapes were slightly darker green showing about 0.1% glucose as compared to the 5.93% cellulose in the initial reaction mass.

EXAMPLE 2

The following reaction mixture was charged into a Resin Reaction flask equipped with agitator and reflux:

| | Wt. (gm) | % of Total Mass |
|---|---|---|
| Newsprint (hemi-cellulose + alpha cellulose) | 300.0 | 10.00 |
| $CaCl_2$ | 600.0 | 20.00 |
| HCl (Con. 38%) | 30.0 | .38 (as HCl) |
| Water (tap) | 2070.0 | 69.00 |
| Total Mass = | 3000.0 | |

In approximately 21 minutes the reaction mass reached a temperature of 104° C at which time the paper began breaking up to pulp. About 3 minutes later the reaction mass attained a temperature of 105° C and reflux began. Although boiling was vigorous, agitation could not be begun. About 5 hours later some paper remained unpulped whereas the remaining mass was pulped and solubilized. A sample of the solubilized mass was tested with Tes-Tape and showed the presence of about ½% glucose. The reflux was continued for an additional 12 hours and intermediate samples were taken which gave positive results for glucose and reducing sugars.

The reducing sugars were determined with the use of Clinitest reagent tablets marketed by Ames Company, Division of Miles Laboratories, Inc., Elkhart, Ind. The tablets contain copper sulfate, sodium hydroxide, sodium carbonate citric acid plus filler and binder. The copper sulfate reacts with the reducing sugar in the test sample, converting the cupric sulfate to cuprous oxide. The resultant color which varies with the amount of reducing substances present ranges from blue through green to orange. A tablet is dropped into a small amount of the sample which has been diluted with water. After waiting 15 seconds, the sample is shaken gently and compared with a color chart from blue (0%) through green to orange (2%) in increments of ¼% reducing sugars.

EXAMPLE 3

The following reaction mixture is charged into a Resin Reaction flask equipped with reflux and agitator:

| | Wt. (gm) | % of Total Mass |
|---|---|---|
| Newsprint | 340.0 | 10.10 |
| $CaCl_2$ | 1500.0 | 44.51 |
| HCl (Con. 38%) | 30.0 | .34 (as HCl) |
| Water | 1500.0 | 44.51 |
| Total Mass = | 3370.0 | |

Below 90° C the paper began to break down immediately. After about 10 minutes and boiling at 116° C, the liquid in the reaction mixture turned dark brown. Within the next 10 minutes where the temperature reached 120°–123° C, there was much foaming and the run was stopped. Tes-Tape showed positive for glucose and Clinitest tablets showed total reducing sugars of over 10% as compared to a newsprint concentration in the reaction mixture of about 10.10%.

EXAMPLE 4

The following reaction mixture was charged into a Resin Reaction flask equipped with agitator and reflux:

| | Wt. (gm) | % of Total Mass |
|---|---|---|
| Newsprint | 90.0 | 4.74 |
| $CaCl_2$ | 900.0 | 47.40 |
| HCl (Con. 38%) | 9.0 | .18 (as HCl) |
| Water | 900.0 | 47.40 |
| Total Mass = | 1899.0 | |

After about 18 minutes with paper pulping, a sample was taken at 84° C and tested with Tes-Tape for glucose (negative) and for reducing sugars with Clinitest tablets (positive ¾%). The temperature was raised to 118° C in the next 16 minutes. Foaming took place, a defoamer was added and the reaction mixture began boiling again. A sample was taken in about 10 minutes at 115° C. which was negative for glucose and showed about 2% reducing sugars. Boiling was continued and additional defoamer was later added. Afte several hours at 116° to 118° C, the reaction was stopped. A sample of the reaction mixture diluted to 1/6 its original concentration indicated by Tes-Tape a glucose concentration of about 1½% and by Clinitest tablets of total reducing sugars of about 4½% as compared to an original concentration of newsprint of about 4.47% in the reaction mixture.

EXAMPLE 5

The following reaction mixture was charged into a Resin Reaction flask equipped with an agitator and reflux:

| | Wt. (gm) | % of Total Mass |
|---|---|---|
| Filter Pulp SS No. 289 (pure alpha cellulose) | 186.0 | 5.66 |
| $CaCl_2$ | 1750.0 | 53.22 |
| HCl (Con. 38%) | 30.0 | .35 (as HCl) |
| Water | 1320.0 | 40.17 |
| Total Mass = | 3286.0 | |

The cellulose began dissolving immediately and, at the end of 5 minutes at 92.5° C, a light beige dispersion formed which, by the Clinitest tablet and Tes-Tape tests, indicated positive for reducing sugars and glucose. The reaction mixture was easily agitated and, in about 30 minutes, attained a temperature of 106.5° C. Foaming began, defoamer was then added and heat continued for 10–15 minutes at 125° C. The Tes-Tape test, at this stage, showed about 2% glucose and the Clinitest tablet test showed reducing sugars over 4%. 18.5cc of 58% ammonia and 800cc $H_2O$ were then added to the reaction mixture. The Clinitest tablet test indicated about 5% reducing sugars and the Tes-Tape test about 3–4% glucose as compared to an original concentration of cellulose in the reaction mixture of about 5.66%.

The reaction product was filtered at room temperature to remove foreign matter and virtually the entire quantity of $CaCl_2$ originally used crystallized out of the filtrate, apparently as $CaCl_2 \cdot 6H_2O$, leaving very little $CaCl_2$ in the glucose solution. The $CaCl_2$ thus apparently acts as a catalyst since it is not used up in the reaction and, of course, can be easily and economically recovered for reuse.

Various standard methods may be employed to purify the glucose reaction product by removal of $Ca^{++}$ and $Cl^-$ ions. Thus, the reaction product, which is generally in colloidal or syrupy form, can be treated with ion exchange resins, such as the Amberlites cation and anion exchange resins marketed by Rohm & Haas, Philadelphia, Pa. The glucose reaction product can be purified as well by the well-known process of ion exclusion or the removal of the non-ionic material, i.e. glucose, using modified resins. As mentioned heretofore, the presence of traces of calcium chloride in the glucose reaction product is not an impediment to the use of the product as fermentation or feed stock.

Based on the total reaction mass, the ranges of the amounts of the reactants required to convert cellulose to the monosaccharides, particularly glucose, are as follows:

| | |
|---|---|
| HCl | 0.01 to 2.0% |
| $CaCl_2$ | 5.0 to 55.0% |
| Cellulose | 0.i to 40.0% |
| $H_2O$ | remainder |

The higher the concentration of $CaCl_2$, the lower the concentration of HCl. Additionally, while the foregoing Examples show the process carried out at reflux at atmospheric pressure, conversion of the cellulose to reducing sugars takes place prior to reflux and, hence, at lower temperatures, the process will simply take longer. Furthermore, under increased pressures, the conversion of the cellulose to the reducing sugars can also be accelerated at, of course, higher temperatures. Accordingly, the instant method can be carried out at temperatures of about 50° to 180° C and at time ranges from about 20 minutes to 48 hours.

The most efficient embodiment of the method for the production of glucose is one in which the reaction mixture contains about 5–6% pure alpha cellulose, the limit of solubility of $CaCl_2$ or about 55%, and a low concentration of HCl of about 0.1%. Within about 20–30 minutes, refluxing the reaction mixture at 125° C will result in near quantitative conversion of the alpha cellulose to glucose and economical recovery of the $CaCl_2$ which crystallizes out of the reaction product, quantitatively, as the hexahydrate when the temperature of the reaction products is reduced to room temperature or below.

The present method requires for conversion of cellulose to reducing sugars of a large amount of $CaCl_2$ relative to a small amount of $H^+$ in the reaction mixture. While this is obtained by using 5–55% $CaCl_2$ and 0.01 to 2% HCl based on the total reaction mass, it is possible to combine the $CaCl_2$ with a non-stoichiometric amount of $H_2SO_4$ whereby only a portion of the $Ca^{++}$ will precipitate as $CaSO_4$, leaving in the reaction mixture $Ca^{++}$, $H^+$ and $Cl^-$ ions and, as long as the relative ratios of the ions is such that, translated in terms of compounds, there remains in the reaction mixture of range of $CaCl_2$ and HCl as aforesaid, the reaction will cause conversion of the cellulose to reducing sugars.

While preferred embodiments have here been described, it will be understood that skilled artisans may make variations without departing from the spirit of the invention and the scope of the appended claims.

What is claimed is:

1. A method of hydrolyzing cellulose to monosaccharides comprised of admixing cellulose, water, at least about 5% $CaCl_2$ and about 0.01% to about 2% HCl, the larger the quantity of $CaCl_2$ the lesser the quantity of HCl and heating the reaction mixture to solubilize the cellulose and until reducing sugars are formed from the solubilized cellulose.

2. The method of claim 1 in which the cellulose is alpha-cellulose and the monosaccharide formed by hydrolysis thereof is glucose.

3. The method of claim 1 wherein the heating of the reaction mixture is carried out under reflux.

4. The method of claim 1 wherein the reaction mixture originally contains about 5% to about 55% $CaCl_2$, and the reaction mixture is heated between about 50° to 180° C for a time sufficient to solubilize the cellulose and form reducing sugars from the solubilized cellulose.

5. The method of claim 4 in which the cellulose is present in the original reaction mixture in an amount of about 0.1% to about 40% based on the total weight of the reaction mixture.

6. The method of claim 1 and reducing the temperature of the reaction product to crystallize the $CaCl_2$ as the hydrate and removing the $CaCl_2$ from the reaction product.

7. The method of claim 1 and purifying the reaction product by separating substantially all of the $Ca^{++}$ and $Cl^-$ ions therefrom.

8. A method of hydrolyzing alpha cellulose to glucose comprised of admixing with water 5–6% cellulose, 53–55% $CaCl_2$ and 0.35 to 0.10% HCl, all based on the total weight of the reaction mixture and refluxing the reaction mixture with agitation for a time sufficient to convert the cellulose to glucose.

9. The method of claim 8 and reducing the temperature of the reaction product to room temperature to crystallize out substantially all of the original $CaCl_2$ as a hydrate and separating the crystallized $CaCl_2$ to leave a relatively pure glucose solution.

10. The method of claim 9 and further purifying the glucose solution by removal of substantially all of the remaining $Ca^{++}$ and $Cl^-$ ions therefrom.

* * * * *